US011741791B2

(12) United States Patent
Riggs et al.

(10) Patent No.: US 11,741,791 B2
(45) **Date of Patent: *Aug. 29, 2023**

(54) WAGERING SYSTEM INCLUDING TOURNAMENT MODE AND THIRD PARTY BETTOR INTERFACE

(71) Applicant: Everi Games, Inc., Austin, TX (US)

(72) Inventors: Keith Riggs, Austin, TX (US); Loren Jacobs, Austin, TX (US); James McHugh, Austin, TX (US); Steven Meyer, Austin, TX (US)

(73) Assignee: Everi Games, Inc., Austin, TX (US)

( * ) Notice: Subject to any disclaimer, the term of this patent is extended or adjusted under 35 U.S.C. 154(b) by 90 days.

This patent is subject to a terminal disclaimer.

(21) Appl. No.: 17/352,208

(22) Filed: Jun. 18, 2021

(65) Prior Publication Data

US 2021/0312765 A1 Oct. 7, 2021

Related U.S. Application Data

(63) Continuation of application No. 16/706,882, filed on Dec. 9, 2019, now Pat. No. 11,043,076, which is a continuation of application No. 15/716,067, filed on Sep. 26, 2017, now Pat. No. 10,504,332, which is a continuation-in-part of application No. 15/687,792, filed on Aug. 28, 2017, now Pat. No. 10,275,992, which is a continuation of application No. 15/263,044, filed on Sep. 12, 2016, now Pat. No. 9,747,754, which is a continuation of application No. 13/925,660, filed on Jun. 24, 2013, now Pat. No. 9,443,394, which is a continuation of application No. 13/241,043, filed on Sep. 22, 2011, now Pat. No. 8,469,788.

(60) Provisional application No. 62/400,047, filed on Sep. 26, 2016, provisional application No. 61/405,652, (Continued)

(51) Int. Cl.
*G07F 17/32* (2006.01)

(52) U.S. Cl.
CPC ..... *G07F 17/3276* (2013.01); *G07F 17/323* (2013.01); *G07F 17/3209* (2013.01); *G07F 17/3211* (2013.01); *G07F 17/3225* (2013.01); *G07F 17/3244* (2013.01); *G07F 17/3286* (2013.01)

(58) Field of Classification Search
CPC ..... G07F 17/32
See application file for complete search history.

(56) References Cited

U.S. PATENT DOCUMENTS

2005/0181856 A1 8/2005 Cannon
2009/0325686 A1 12/2009 Davis

*Primary Examiner* — Omkar A Deodhar
(74) *Attorney, Agent, or Firm* — The Culbertson Group, P.C.; Nathan H. Calvert

(57) ABSTRACT

Methods, systems, devices, and software products are provided for slot machine tournaments to allow bettors to bet on slot machine tournament players and events. A bettor interface is provided showing a group of currently remaining gaming machines in the competition and enabling selection of machines to wager upon, and a wagering interface display area presents a group of potential wagers to be made. At least some of the potential wagers presented with a target point total and calculated wager odds of reaching said target point total. Fixed or portable devices may be programmed to connect to the network to access the competition wager interface and allow bettors view, make selections, and activate wagers on the eventual outcome of the competition through the competition wager interface.

20 Claims, 7 Drawing Sheets

Related U.S. Application Data filed on Oct. 22, 2010, provisional application No. 61/388,590, filed on Sep. 30, 2010.

1004

1004

WAGERING SYSTEM INCLUDING TOURNAMENT MODE AND THIRD PARTY BETTOR INTERFACE

CROSS-REFERENCE TO RELATED APPLICATIONS

This application is a continuation of U.S. patent application Ser. No. 16/706,882, filed Dec. 9, 2019, entitled "Wagering System Including Tournament Mode And Third Party Bettor Interface," which application is a continuation of U.S. patent application Ser. No. 15/716,067, filed Sep. 26, 2017, entitled "Wagering System Including Tournament Mode And Third Party Bettor Interface," which application is a continuation-in-part of U.S. patent application Ser. No. 15/687,792, filed Aug. 28, 2017, entitled "Gaming System and Method With a Real-Time Streaming Video Feed and Display," which application is continuation of U.S. patent application Ser. No. 15/263,044, filed Sep. 16, 2016, entitled 'Convertible In-Revenue And Out-Of-Revenue Gaming System And Method With A Real-Time Streaming Video Feed And Display' (now U.S. Pat. No. 9,747,754), which application is a continuation of U.S. patent application Ser. No. 13/925,660 filed Jun. 24, 2013, and entitled "Convertible In-Revenue and Out-of-Revenue Gaming System and Method with a Real-Time Streaming Video Feed and Display" (now U.S. Pat. No. 9,443,394) which is a continuation of U.S. patent application Ser. No. 13/241,043 filed Sep. 22, 2011, and entitled "Convertible In-Revenue and Out-Of-Revenue Gaming System and Method With A Real-Time Streaming Video Feed and Display," (now U.S. Pat. No. 8,469,788), which claims the benefit, under 35 U.S.C. § 119(e), of U.S. Provisional Patent App. No. 61/388,590 filed Sep. 30, 2010, entitled "Convertible In-Revenue and Out-Of-Revenue Gaming System and Method With A Real-Time Streaming Video Feed and Display," and U.S. Provisional Patent App. No. 61/405,652 filed Oct. 22, 2010, having the same title. The entire content of each of these applications is incorporated herein by this reference.

This application also claims the benefit, under 35 U.S.C. § 119(e), of U.S. Provisional Patent App. No. 62/400,047 filed Sep. 26, 2016, entitled "Wagering System Including Tournament Mode and Third Party Bettor Interface." The entire content of this application is incorporated herein by this reference.

TECHNICAL FIELD OF THE INVENTION

This invention relates to wagering games, gaming machines, gaming systems, and associated methods. More particularly, the invention relates to out-of-revenue tournament gaming machines, systems, and related methods.

BACKGROUND OF THE INVENTION

Various gaming systems have been developed to provide in-revenue and out-of-revenue gaming machines and systems. Most of those systems are either dedicated to in-revenue operation or out-of-revenue operation. An example of in-revenue operation is where play at a gaming machine or system is initiated with a money (or equivalent) wager by a player. An example of out-of-revenue operation is where game play at a gaming machine or system does not require a wager (e.g. tournament or free play).

There continues to be a need for innovative methods and gaming systems which provide convertibility between in-revenue and out-of-revenue gaming operation. There is also a need for innovative methods and systems for presenting tournament games in different ways to generate player interest and excitement.

SUMMARY OF THE INVENTION

Methods, systems, devices, and software products are provided for slot machine competitions to allow bettors to bet on slot machine competition players and events. A bettor interface is provided showing a group of currently remaining gaming machines in the competition and enabling selection of machines to wager upon, and a wagering interface display area presents a group of potential wagers to be made. At least some of the potential wagers presented with a target point total and calculated wager odds of reaching said target point total. Fixed or portable devices may be enabled to connect to the network to access the competition wager interface and allow bettors view, make selections, and activate wagers on the eventual outcome of the competition through the competition wager interface.

In accordance with one or more embodiments of the present invention, a convertible in-revenue and out-of-revenue gaming system includes a control center server connected to automatically convert operating modes and control in-revenue and out-of-revenue operations of one or more banks of gaming machines. A competition wagering controller provides an interface for bettor devices to place wagers on competition players. Each gaming machine may include a video camera connected to provide a live video feed to one or more displays, such as during competition play when live video feed of the players and the player competition positions may be driven in real-time to an overhead display by the control center server operating in a competition controller mode.

These and other advantages and features of the invention will be apparent from the following description of illustrative embodiments, considered along with the accompanying drawings.

DESCRIPTION OF REPRESENTATIVE EMBODIMENTS

Systems, methods, devices, and program products are described herein including a bettor interface allowing bettors to wager on the outcome of a slot tournament. The preferred version is embodied as an improvement to the inventions described in the above-cited related application titled "Convertible In-Revenue And Out-Of-Revenue Gaming System And Method With A Real-Time Streaming Video Feed And Display". As such, the features herein may be used in any working combination or subcombination with the features of the related applications above, for example U.S. Pat. No. 9,443,394. The details set forth in the related applications will not be repeated except as necessary to set forth the present invention, however the related applications are incorporated by reference above in this disclosure.

Figure 1:
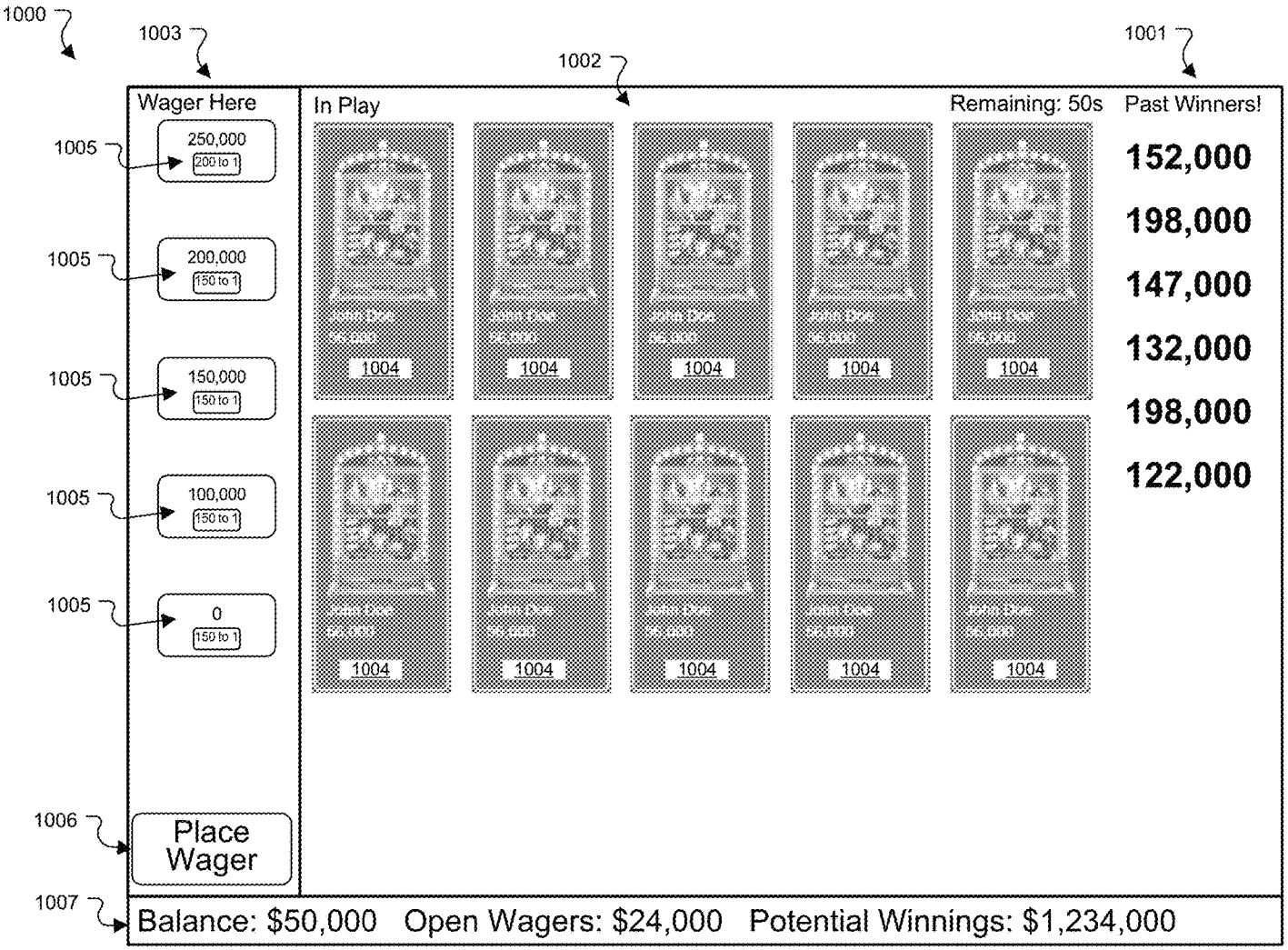
FIG. 1 shows an example bettor interface allowing bettors to wager on the outcome of a slot tournament.
Figure 2:
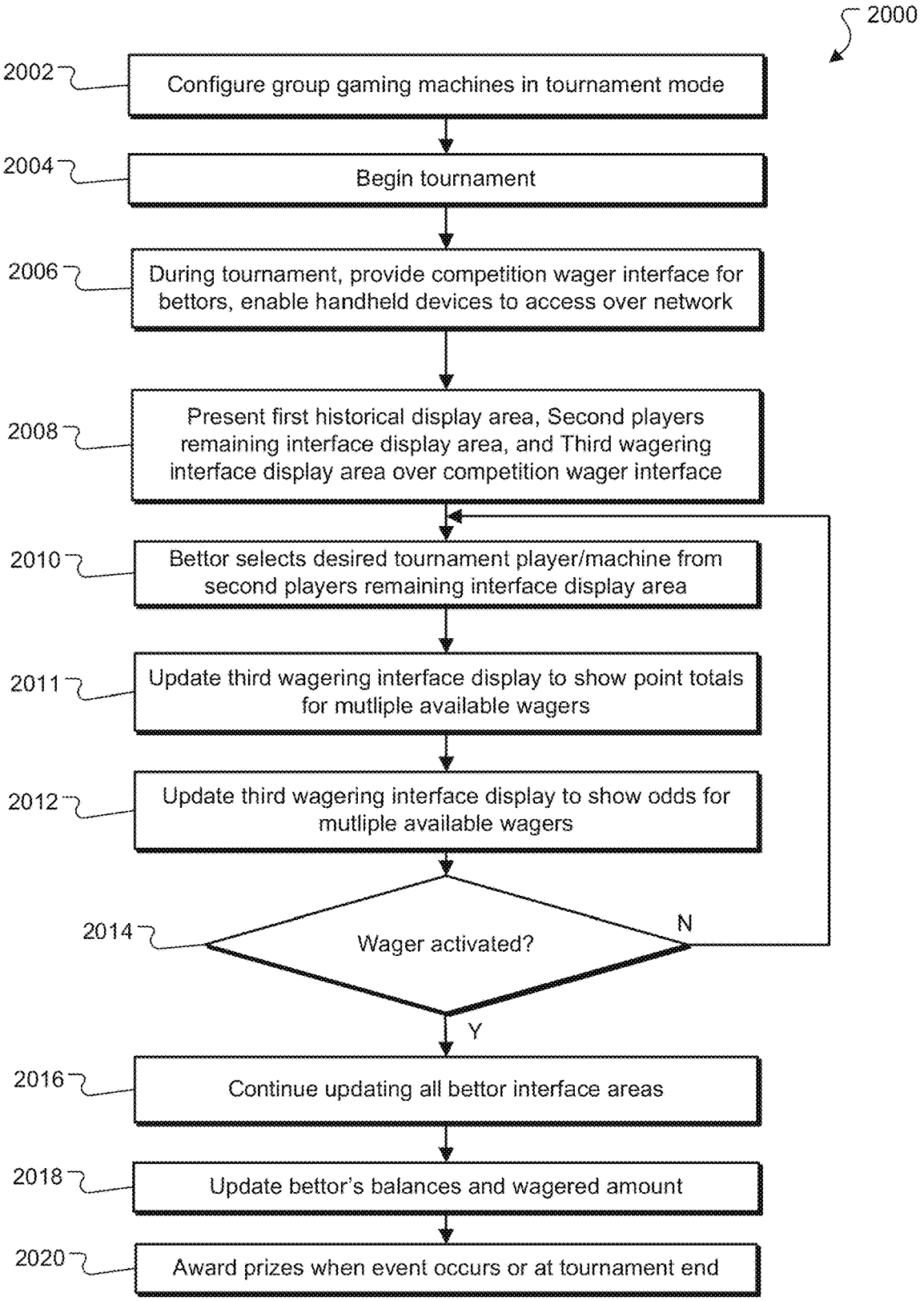
FIG. 2 shows an example flowchart of how the bettor interface may be presented and used along with a tournament or competition on a group of networked gaming machines.

FIG. 1 shows an example bettor interface allowing bettors to wager on the outcome of a slot tournament. The term "bettor" is used to distinguish from the players in the tournament or competition game. The bettors may also be players, or may be merely observers of the tournament on site or remotely. The bettors may be at a third party location, or may be third parties, i.e. not participating in the tournament or transaction between the players and the casino, besides their participation in the wagers described herein. FIG. 2 shows an example flowchart of how the bettor interface may be presented and used along with a tournament or competition on a group of networked gaming machines.

Referring to FIGS. 1-2, the process 2000 of operating the gaming system including a set of networked gaming machines generally begins at process block 2002 where, under control of a tournament controller operatively connected to the set of networked gaming machines, the process configures at least some of the set of networked gaming machines to work in a competition operating mode for group play. Typically the competition mode is an out-of-revenue slot tournament or a tournament round, but other group competition games may be used such as in-revenue competitions. Next at block 2004, the process begins the competition mode and begins tracking the various players in the tournament and calculating wagering odds for reaching various point levels such as the different point levels and odds displayed in third indicators 1005 in FIG. 1. At block 2006, the process, during the competition operating mode, provides a competition wager interface under control of the tournament controller or a tournament wagering controller connected to the tournament controller. The competition wager interface, or "bettor interface", may also be made available before competition play starts at block 2004, with a fixed set of odds made available for bettors based on the general probability of a single, unspecified, player to reach the designated point totals.

Figure 6:
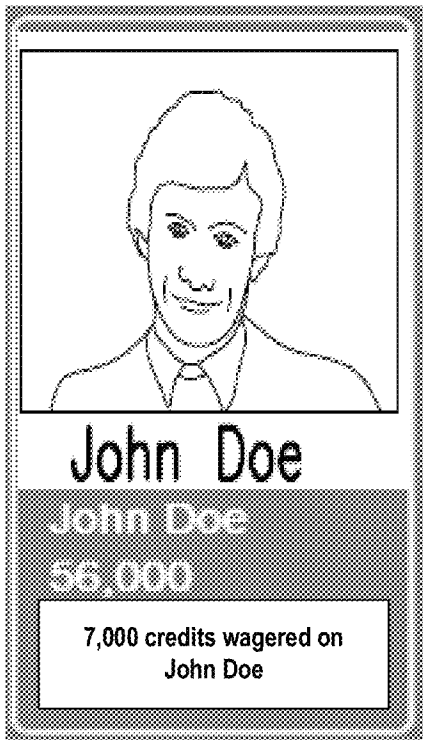
FIGS. 5-6 show examples of alternate currently remaining gaming machines indicators used in the bettor interface.
Figure 5:
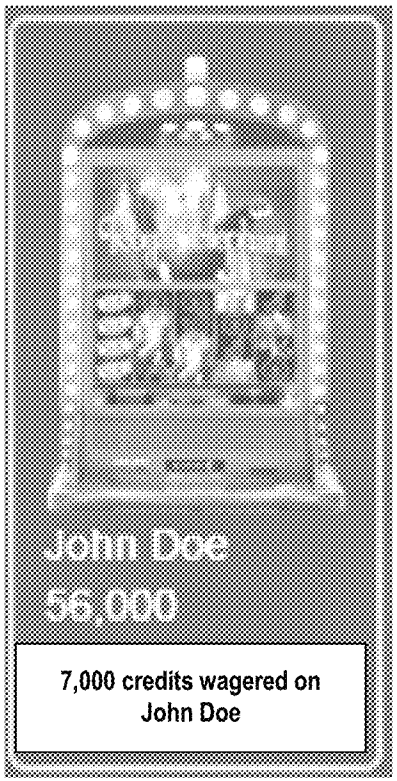

An example competition wager interface 1000 ("bettor interface 1000") is show in FIG. 1, and may be provided on terminals, networked gaming machines, mobile devices, or over the internet as further described below. When provided on a networked gaming machine, the interface is preferably presented on an upper, secondary display which are commonly present on casino gaming machines. Providing the interface includes presenting the display the various active or passive portions of the interface and receiving and reacting to bettor inputs at the respective bettor devices. Presenting the interface at block 2008 includes causing display of a first historical display area 1001 showing a number of past tournament winner point totals. Historical portion 1001 may also be presented in a graphical form such as a bar chart showing how often different point totals are reached. Block 2008 includes presenting a second players remaining interface display area 1002 labelled "In Play" which shows indicators for a group of currently remaining gaming machines 1004 in the competition and their point totals and enabling selection of one or more of the currently remaining gaming machines to wager upon. The indicators 1004 include the current point total reached by the player, and may include the player's name as indicated by the name field showing "John Doe" for all the players. Other versions of indicator 1004 may include an indicator of the total credits wagered by bettors on the player, as shown in the diagram of FIG. 5. Other versions may also show a picture or live video feed of the player provided through a camera on the gaming machine, as shown in the diagram of FIG. 6. The second players remaining interface display 1002 area may include an indication of how much bettor wagering is backing the respective participants in the group play, the second players remaining interface display area including an option activatable by the bettor to sort the players remaining by amount wagered on the respective players remaining.

Presenting the bettor interface 1000 also includes causing display of a third wagering interface display area 1003 shown with the label "Wager Here", which is controlled by the selection of the one or more currently remaining gaming machines indicators 1004, and presenting a group of potential wagers 1005 to be made on the eventual outcome of the competition, at least some of the potential wagers presented with a target point total and calculated wager odds of reaching said target point total. The displayed odds are preferably adjusted as the tournament progresses to reflect the current point totals reached by each player. This has the advantage of allowing the bettor interface 1000 to provide bettors with ability to wager as the tournament progresses, a more exciting scenario than merely wagering before the tournament starts on a desired player to win or achieve a certain point goal. The displayed odds in items 1005 are based at least on the current point score of the selected tournament player. The displayed odds at items 1005 may also be based on the credits wagered on particular players, providing ability to "make book" or adjust the payouts available for a particular wager based on the risk to the casino operator. Further, while the depicted third wagering interface display area 1003 shows items 1005 with available wagers and odds for reaching a designated point total, other types of wagers may be available, such as "win", "win, place, or show", or other wagers such as achieving certain competition or tournament goals particular to the particular competition or tournament conducted.

The depicted process at blocks 2010 through 2014 shows how process is enabled on at least one handheld device or other connected to the network to access the competition wager interface to allow a bettor on the device to view, make selections, and activate wagers on the eventual outcome of the competition through the competition wager interface. Multiple bettors preferably bet on each tournament, and there may be more bettors than tournament players. At block 2010, the bettor selects as desired player/machine by selecting an indicator 1004, in response to which the process updates the third wagering interface display 1003 at block 2011 to show the point totals for multiple available wagers for the selected players, such as the totals shown in FIG. 1. The available point totals are based on the current point total of the player and a predetermined set of achievable point totals such as 100,000, 150,000, etc shown in FIG. 1. At block 2012, the process also updates the wagering odds for each available wager, which may be done based on the current point totals and also on existing wagers in the system that effect the required payout (bookmaker risk) should the wagered upon event occur. While these steps are shown sequentially, the process preferably keeps these available wagers and odds updated on an ongoing basis in response to wagers made on the system and point levels achieved by each of the tournament players.

A bettor selects a desired wager from the third wagering interface display 1003, and may be required to confirm placing a wager or activate a separate "place wager" button 1006 to enter the wager at block 2014. When a wager is activated at block 2014, the process continues to update all the bettor interface areas at block 2016 and allows further selections and wagers to be entered. The process also updates the bettor's balances and amounts wagered, such as those amounts on line 1007 of FIG. 2. Next, at block 2020, the process awards prizes to the bettors when bettors based on winning their activated wager, preferably when the wagered upon event is actually achieved in the tournament or competition, or at the end of the competition.

Figure 7:
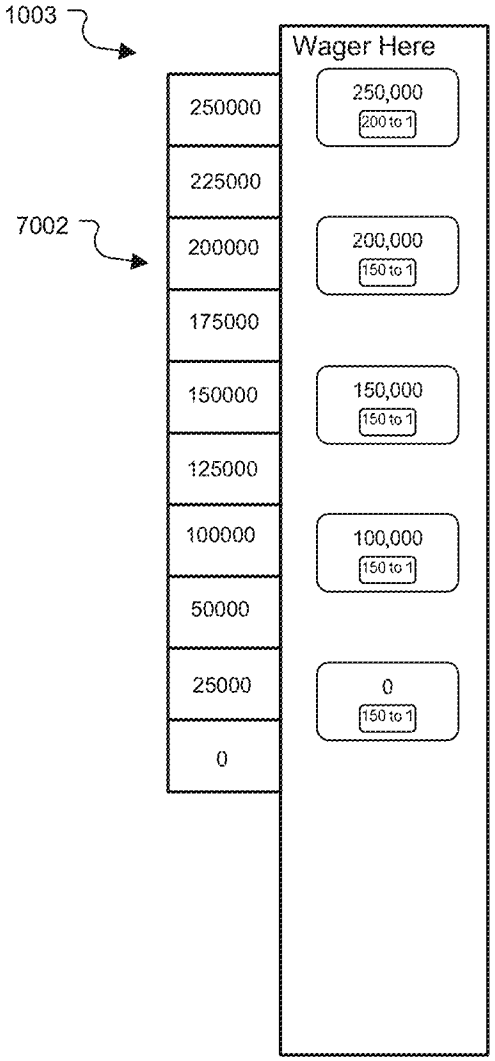
FIG. 7 shows an example of an alternate wagering interface display area with a meter.

In some versions, the process may also provide that the third wagering interface display area includes a graphical meter presented behind or beside the presentation of the group of potential wagers, such as the meter 7002 shown in FIG. 7. The graphical meter indicates a current point score associated with the current selection from the remaining gaming machines, and typically shows the meter lighting up to higher levels as the selected player/machine achieves those higher point levels. The meter 7002 may include lighted segments or a single growing light bar, and preferably includes marked or delineated levels so the bettor can see the current point score of the selected player/machine relative to the available wagers and odds. The meter 7002 may include selectable segments with the odds shown therein, replacing the button-like indicators 1005 shown in FIG. 1.

Figure 8:
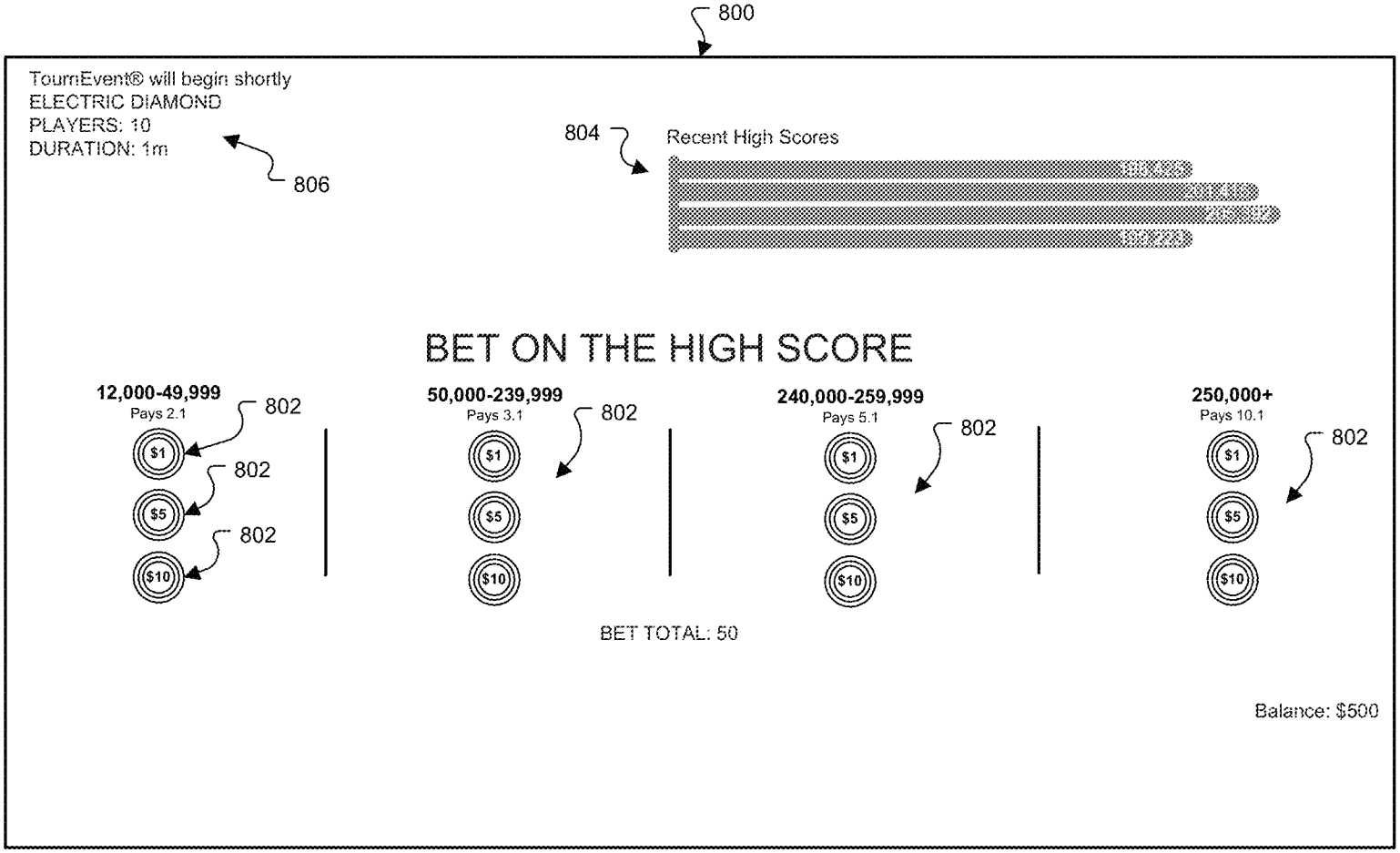
FIG. 8 is a screen diagram of a high score betting interface according to another embodiment.

FIG. 8 is a screen diagram of a high score betting interface 800 according to another embodiment. The depicted example interface allows bettors another method of wagering on a tournament game based on wagering on what the high score will be that wins the tournament, independent of the player that wins. Interface 800 includes betting buttons 802 labelled with the amount to waver, arranged in columns underneath the respective high score range on which the bettor wishes to wager. For example, if the bettor wants to wager that the winning high score will be between 12,000 and 49,999, the left-hand depicted betting buttons 802 allow the player to place a $1, $5, or $10 wager on that outcome. A group of indicator bars 804 in a historical display area show recent high scores is shown to give the bettors more information on which to decide their wager. The interface of FIG. 8 may be provided for bettors to wager on an ongoing tournament in a process similar to that of FIG. 2, but without the selection of a specific tournament player or machine on which to wager at block 2010. The process may or may not include showing a 'players remaining' interface area like area 1002 of FIG. 1, and instead may use the status display 806 to display text showing the current status of the tournament, such as whether it is active or yet to begin, the game title or tournament title, and number of players enrolled or remaining, and the remaining duration of the tournament. Similarly to the process of FIG. 2, the interface of FIG. 8 allows bettor wagering while a tournament is in progress, and the betting odds displayed for each depicted high score range are updated as the tournament progresses to allow continued wagering. The interface may also include a tab or other button allowing switching back and forth between a player-focused wagering scheme like that of FIG. 1 and an overall high score scheme like that of FIG. 8, allowing wagers to placed in each scheme. While the interface shown provides wagering for a single tournament, typically the system provides bettors the ability to select any of multiple tournaments on the network and enter a similar interface for each.

Figure 3:
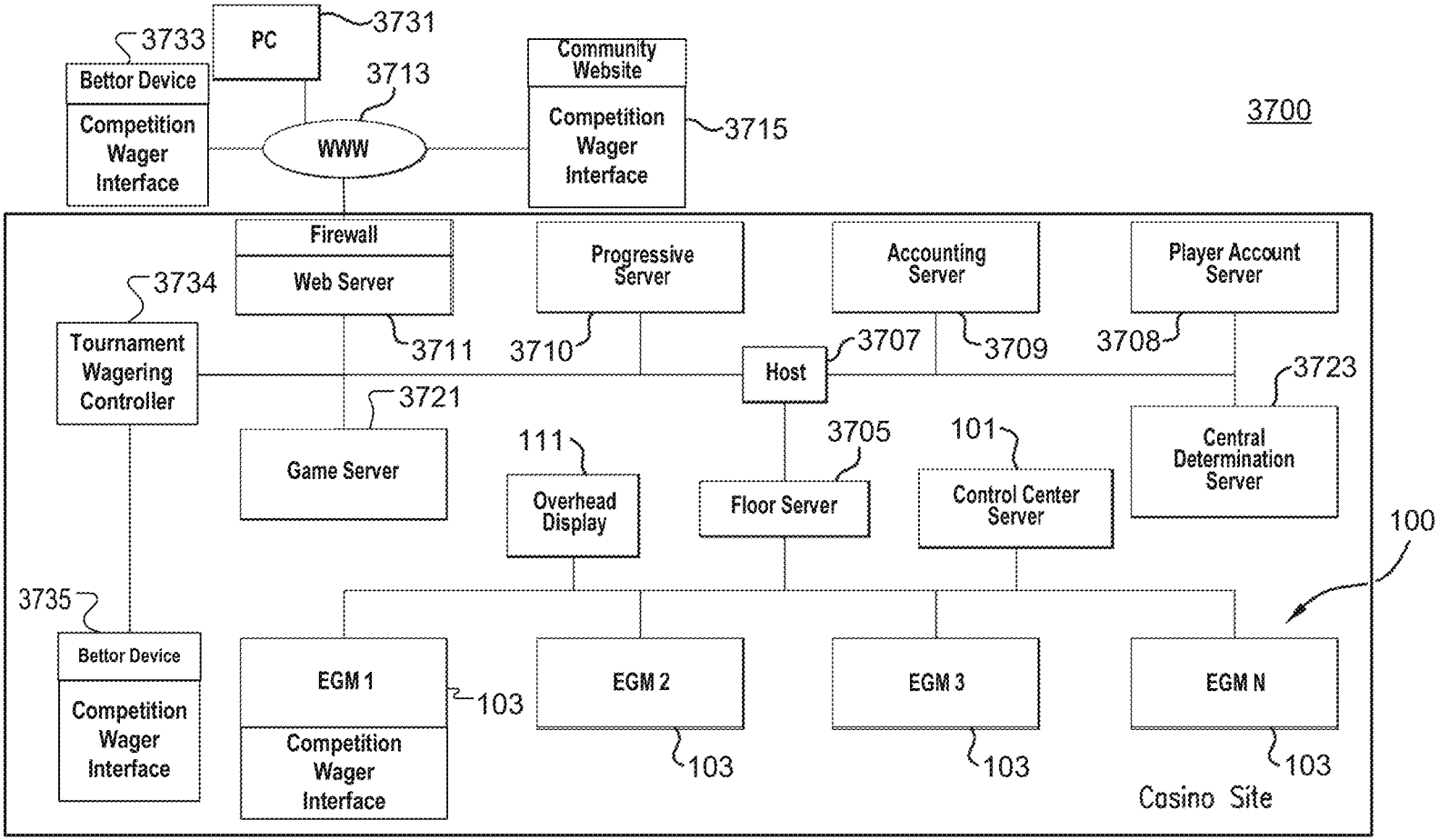
FIG. 3 shows a network diagram depicting various network locations at which the competition wager interface may be presented on network connected devices.

FIG. 3 shows a network diagram depicting various network locations at which the competition wager interface 1000 may be presented on network connected devices. Generally, the methods herein can also allow at least one internet connected computer or mobile device such as the depicted device 3733 connected to internet 3713 to access the competition wager interface hosted through a website or app server 3715 and allow further bettors on the mobile device to view, make selections, and activate wagers on the eventual outcome of the competition through the competition wager interface. Inside the casino network, a mobile or fixed device 3735 may connect to the tournament wagering controller 3734, which hosts the tournament wagering interface and responds to bettor inputs. As shown, networked gaming machines may also present the tournament wagering interface, preferably on an upper secondary display of the gaming machine, which may be done for machines not in participating in the tournament, or for machines participating in the tournament.

The block diagram generally shows an example networked gaming system 3700 which may be any suitable system such as those described in the related applications cited above. The system is associated with one or more gaming facilities is shown including host server 3707 connecting to a set of backend servers and floor server 3705 which in turn connects to a network of gaming machines 103 including one or more convertible in-revenue/out-of-revenue gaming systems 100 in accordance with one or more embodiments. Each of the convertible in-revenue/out-of-revenue gaming systems 100 includes control center server 101, one or more banks of the networked gaming machines 103, and overhead display 111 (optionally) operably connected to automatically convert the gaming operating mode of each of the banks from in-revenue to out-of-revenue and vice-versa as described above.

As shown in FIG. 3, one or more overhead displays 111 and one or more control center servers 101 may be network connected through Floor Server 3705 to Host Server 3707 which in turn connects to various back-end servers, such as player account server 3708, accounting server 3709, progressive server 3710, web server 3711, game server 3721, and central determination server 3723 (the latter being employed in the case of Class II gaming operations for example).

In one or more embodiments, game server 3721 may provide server-based games and/or game services to network connected gaming devices, such as gaming machines 103 (which may be connected by network cable or wirelessly). Progressive server 3710 may accumulate progressive awards by receiving defined amounts (such as a percentage of the wagers from eligible gaming devices or by receiving funding from marketing or casino funds) and provide progressive awards to winning gaming devices upon a progressive event, such as a progressive jackpot game outcome or other triggering event such as a random or pseudo-random win determination at a networked gaming device or server (such as to provide a large potential award to players playing the community feature game). Accounting server 3709 may receive gaming data from each of the networked gaming devices and perform audit functions. Player account server 3708 may maintain player account records and persistent data such as accumulated player points. While FIG. 3 shows some servers have been separately, they may be combined or split into additional servers having additional capabilities. In particular, the controller functions provided by central control server 101 may be performed by floor server 3705 or some other physical data processing system included in networked gaming system 3700. Further, as described above, the control center server 101 is one version of a tournament controller configured to selectively instruct one or more of the gaming machines, the tournament controller or a tournament wagering controller 3734 connected to the tournament controller further operable to provide a competition wager interface for wagering on the tournament outcome according to the process described with respect to FIG. 1-2. The tournament wagering controller 3734 may be a separate server or integrated with control center server 101.

In one or more embodiments, networked gaming system 3700 may include web server 3711 connected to a public web network, such as worldwide web (WWW) network 3713. Community Website 3715 may externally connect through network 3713 to web server 3711 through a firewall in order to provide access by networked gaming system 3700 to player information, such as a player's community website game or associated points obtained from non-wagering gaming activity. Such a service, for example, may be offered to a casino operator on a fee basis or through a subscription service with the community website provider, whereby a casino operator may access a player's records, view a player's activity at community website 3715, and choose, based on the player's activity, to offer or provide promotional credits or incentives to the player at the casino operator's facilities. Community website 3715 may be the host server for a competition wager interface presented to internet connected devices such as device 3733. In such cases, a secure protocol is preferably established through the firewall to allow internet based bettors to access the tournament wagering controller 3734 capabilities.

Community website 3715 may offer players a variety of games to play including a tournament or other competitive game which may be operated substantially as disclosed above. For example, the website may include a menu of available games which may include tournament or tournament qualifying games that may be played at the request of a player-visitor to community website 3715. In these examples, one or more tournaments or competitions may be programmed, such as through control center server 101 as substantially described herein or a server hosting community website 3715, and made available for participants to enroll (such as by paying a fee using a credit card or, if no fee is required, by simply entering a player name) and play a game associated with a selected tournament or competition during an active period of the selected tournament or competition, such as during a 24 hour, 1 week, or 1 month period. The scores achieved by each of the participants during the active tournament or competition period may be posted on a leader board that may be displayed on Community Website 3715. Each participant may play the associated game on personal computer 3731 or wireless device 3733, such as an iPad® tablet or, an iPhone® or Blackberry® phone, personal data assistant, etc. which may connect through internet 3713 to Community Website 3715. Each participant may use the associated keyboard or touchpad of their internet device as a user interface to perform the functions of a button deck on gaming machines 103 and view the game through the associated display. In one or more embodiments, in addition to the conventional game play initiated by pressing the play button (e.g. 'enter' button on player keyboard), random or pseudo-random interactive bonus features may display on or about the game display and player may have the opportunity to score additional points by popping or selecting one or more items such as by pressing the 'space' bar.

While playing, if the participant has a video camera operational, the participant's video stream may be displayed on a webpage of Community Website 3715 along with a real-time updated score and position on the leader board. Also, any other participants who may be playing in the selected tournament or competition, may have their video, score, and position displayed either simultaneously with the other participants or on a rotational basis. Depending upon the size of the participant's display, a portion of the player's screen may be used for the game while another portion may show the leader board and participant videos. The bettor devices 3733 and 3715 may also include a camera for showing video of the bettors celebrating their wins on the leader board.

The tournaments or competitions as described may be played on demand by a participant, in which case players may be provided a window of time in which to play in the tournament or competition, such as a day, week, or month. Alternatively, the tournaments or competitions may be scheduled as described herein by programming such as through the use of control center server 101 and played on a scheduled basis with a fixed start and stop time. Tournaments or competitions may be played in sessions or at one time. Tournaments or competitions may include several heats, such that winners from sessions in a first heat may advance to play in a second heat and so forth until a final heat is completed to determine the winners.

One example of an out-of-revenue operational mode upon which bettors may bet through interface 1000 may be a tournament event (such as shown for example in FIG. 4) wherein a game having the same pay table and volatility is installed and operational on each of gaming machines 103. During a tournament event, each participating gaming machine 103 may be operated without funds, players may accumulate virtual points or dollars by playing a game on their respective gaming machine 103, and one or more winners may be identified based on the accumulated totals obtained during a predetermined period of time, which may correspond to a programmed or manually initiated definitive start and stop time or a predetermined number of plays. For example, an operator may initiate a tournament event by using a menu program with the console connected to control center server 101 and selecting: the participating gaming machines, an amount of time for the tournament to play, and begin tournament. Alternatively, the predetermined period of time may comprise randomly triggered start and/or stop times, such as through a game event or through use of a random number generator. During the tournament event, each participating gaming machine may capture live streaming video of tournament contestants through respective cameras at the gaming machines 103 and transfer the live video feed in accordance with programming to selected locations, such as overhead display 111 or players remaining interface display area 1002 of bettor interface 1000.

Throughout the tournament event, leader board 601 may be displayed on a real-time basis to present tournament standings and live video feed 603 may be displayed to present player reactions on overhead display 111. Leader board 601 may also be updated to show total wagers placed on each player by bettors. During tournaments, the player's video may be displayed for a certain amount of time along with their current position. The video feed may then be switched so that overhead display 111 shows live video of another player participating in the tournament. In one implementation, video of all players in the tournament, or some subset such as the top five players, may be serially displayed on overhead display 111. That is, video of the first place player is displayed for a time, then switched to the second place player, then the third place player and so forth, returning to video of the first place player upon completion of showing all or the designated subset of players. Also, some implementations may cause the video displayed at overhead display 111 to be switched when there is a change in rankings of the players in a tournament. For example, the video displayed at overhead display 111 may be switched to live video of the new first place player when a lower ranking player overtakes the leader to become the new first place player. At the completion of a tournament the winner's video may be shown on overhead signs with a celebratory message. In one or more instances, a player may opt for anonymity while playing. In one or embodiments, the player may select a player avatar from a set of available avatars and/or a pseudonym which may be displayed in place of a live video feed of the player. Further, at the conclusion of a tournament, or when a player reaches a milestone on which bettors have bet, the leader board may be update to indicate celebratory messages telling the player that designate bettors have won their bets based on the players progress. Video of the bettors may also be shown to encourage and thank the player for achieving the milestone. Generally the processes described above may also include simultaneously displaying a leader board at a respective display system of at least one of the networked gaming machines converted to the competition operating mode, the leader board including current relative positions of participants in the group play, the leader board further including an indication of how much bettor wagering is backing the respective participants in the group play.

Figure 4:
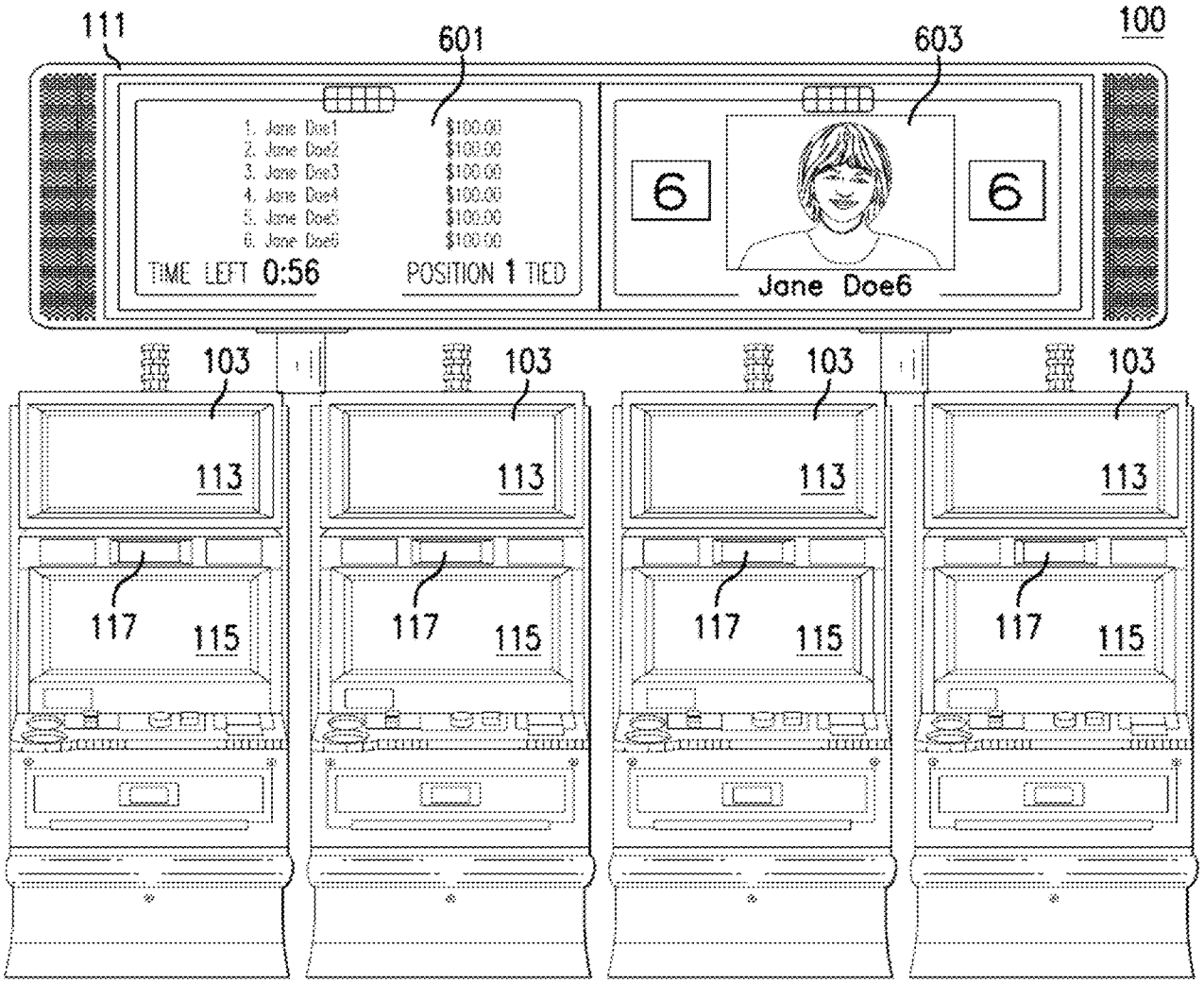
FIG. 4 shows an example embodiment of convertible in-revenue and out-of-revenue game system with a bank of gaming machines in a tournament mode.

Referring to FIG. 4, an example embodiment of convertible in-revenue and out-of-revenue game system 100 is shown with a bank of gaming machines 103 in a tournament mode (which may be operable either in out-of-revenue or in-revenue modes) and with overhead display 111 showing an example real-time leader board 601 and player video feed 603 in accordance with one or more embodiments wherein players at each of the gaming machines 103 compete by playing their respective gaming machine 103 and accumulating a total award based on their play. In the example, each of gaming machines 103 are operating the same game as shown on display 115 and leader board 601 is displayed on display 113 as well as on overhead display 111. Overhead display 111 also displays player video feed 603 which includes the image of one of the players; in the example shown, the video image displays the player, the player's name, and the player's position in the competition (6th place as reflected by the '6' displayed adjacent the player's image). Leader board 601 includes the first five player's position, name, and accumulated point total. Leader board 601 may be updated in real-time to show current positions and accumulated point totals of the respective players. Additionally, leader board 601 may sequentially display standings of each of the players, such as by cycling through all the player positions from first through the total number of participating players. On each of gaming machines 103, display 115 may be personalized to show the top player's positions while also showing the name of the player playing the respective gaming machine displayed as a header and the player's name, position and accumulated points highlighted on the leader board. In the example, the name of the respective player, position, and points may be circled on the respective display 113 so that the player at that gaming machine 103 may readily identify their ranking. In the case where the respective player is not in the top five, then the player's name, position, and accumulated points may be appended to the bottom of the displayed leader board on display 113 of that player's gaming machine 103.

In one or more embodiments, video feed may be delivered to each of displays 113 during an event to show video feeds of each of the participating players, such as by cycling every five seconds to rotate real-time or quasi-real-time images of the players, and/or to show a video feed of the respective player during the course of the event.

In one or more embodiments, the player video feeds and the leader board may be broadcast to wireless devices, such as cellular phones. For example, a gaming facility or operator may maintain a website server and website, enabling individuals to dial- or log-in to the website to receive audio-visual broadcasts of events occurring within the facility. The website server may receive updates through the network of various events that may be occurring simultaneously and update web pages associated with the website, enabling visitors to the website to view streaming and fixed content. The website may be maintained through a controlled-access intranet or broadly accessible internet service. In the case of controlled-access, each patron of a gaming facility may be provided a temporary username and password, such as may be provided during a patron's stay at a resort associated with the gaming facility. Patrons may thereby use their remote wireless device to enroll in a gaming event and pay an entry fee, monitor their time to attend the gaming event, and monitor their position within a gaming event in the case where there are more than one session or round associated with the gaming event.

In one or more embodiments, the invention further may be embodied as one or more tangible nontransitory computer readable medium containing program code instructions executable for providing the processes described above. Such program code may be executable by the systems described above, such as the tournament controller or a tournament wagering controller, alone or in combination with related client program code. Other suitable systems may also execute the program code. Further, the invention may be embodied as a mobile or fixed terminal device programmed to interact with the tournament wagering controller 3734 to provide the bettor interface 1000 according to the various embodiments herein.

Referring generally to the forgoing description and to the following claims, as used herein the terms "comprising," "including," "carrying," "having," "containing," "involving," and the like are to be understood to be open-ended, that is, to mean including but not limited to. Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The term "each" may be used in the following claims for convenience in describing characteristics or features of multiple elements, and any such use of the term "each" is in the inclusive sense unless specifically stated otherwise. For example, if a claim defines two or more elements as "each" having a characteristic or feature, the use of the term "each" is not intended to exclude from the claim scope a situation having a third one of the elements which does not have the defined characteristic or feature.

The above described example embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A method of operating a gaming system, the method including:

(a) under control of a wagering controller, enabling a group of gaming machines connected to the wagering controller over a network to participate in a competition operating mode including group play;

(b) during the competition operating mode, providing a competition wager interface under control of the wagering controller, including a first players remaining interface display area showing a group of currently remaining gaming machines in the competition and enabling selection of one or more of the currently remaining gaming machines to wager upon, and a second wagering interface display area controlled by a selection from the one or more currently remaining gaming machines and presenting a group of potential wagers to be made on an eventual outcome of the competition, at least one of the potential wagers presented with a respective target result and calculated wager odds of reaching that respective target result;

(c) enabling a device to access the competition wager interface and allow a first bettor to view, make selections, and activate wagers on the eventual outcome of the competition through the competition wager interface, the device comprising (i) a remote device which is remote to the gaming system with the wager competition interface displayed on an electronic display associated with the remote device or (ii) one of the gaming machines with the wager competition interface displayed on an electronic display of that gaming machine; and (d) awarding a prize to the first bettor based on winning an activated wager of the first bettor.

2. The method of claim 1 wherein the second wagering interface display area includes a graphical meter presented indicating a current point score associated with the selection of the one or more currently remaining gaming machines.

3. The method of claim 1, further comprising enabling at least one handheld device to access the competition wager interface and allowing second bettor on the handheld device to view, make selections, and activate wagers on the eventual outcome of the competition through the competition wager interface.

4. The method of claim 1, further including simultaneously displaying a leader board at a respective display system of at least one of the gaming machines converted to the competition operating mode, the leader board including current relative positions of participants in the group play, the leader board further including an indication of how much bettor wagering is backing the respective participants in the group play.

5. The method of claim 4 wherein the indication of how much bettor wagering is backing the respective participants in the group play includes a numerical bettor indicator adjacent to a symbol or video feed representing the respective participants in the group play and showing a total amount wagered on the respective participant by bettors.

6. The method of claim 1 wherein the competition wager interface includes an indication of how much bettor wagering is backing the respective participants in the group play, the first players remaining interface display area including an option activatable by the first bettor to sort players remaining by amount wagered on the respective players remaining.

7. The method of claim 1 wherein the first players remaining interface display area includes a video feed of the respective players remaining.

8. A gaming system including:

(a) a plurality of gaming machines;

(b) each gaming machine including a video camera operable to generate a player video feed of a player at the respective gaming machine;

(c) a wagering controller operable to selectively instruct one or more of the gaming machines over a network, the wagering controller further operable to provide a competition wager interface for facilitating wagering on a competition outcome by:

(i) configuring at least some of the gaming machines to work in a competition operating mode for group play;

(ii) during the competition operating mode, providing a competition wager interface under control of the wagering controller, including a first players remaining interface display area showing a group of currently remaining gaming machines in the competition and enabling selection of one or more of the currently remaining gaming machines to wager upon, and a second wagering interface display area controlled by a selection from the one or more currently remaining gaming machines and presenting a group of potential wagers to be made on an eventual outcome of the competition, at least one of the potential wagers presented with a respective target result and calculated wager odds of reaching that respective target result;

(iii) enabling a device to access the competition wager interface and allow a first bettor to view, make selections, and activate wagers on the eventual outcome of the competition through the competition wager interface, the device comprising (A) a remote device which is remote to the gaming system with the wager competition interface displayed on an electronic display associated with the remote device or comprising (B) one of the gaming machines with the wager competition interface displayed on an electronic display of that gaming machine; and (iv) awarding a prize to the first bettor based on winning an activated wager of the first bettor.

9. The gaming system of claim 8, wherein the second wagering interface display area includes a graphical meter indicating a current point score associated with the selection of the one or more currently remaining gaming machines.

10. The gaming system of claim 8, the wagering controller further operable for allowing at least one handheld device to access the competition wager interface and allow a second bettor to view, make selections, and activate wagers on the eventual outcome of the competition through the competition wager interface.

11. The gaming system of claim 8, the wagering controller further operable for allowing simultaneously displaying a leader board at a respective display system of at least one of the gaming machines converted to the competition operating mode, the leader board including current relative positions of participants in the group play, the leader board further including an indication of how much bettor wagering is backing the respective participants in the group play.

12. The gaming system of claim 11, wherein the indication of how much bettor wagering is backing the respective participants in the group play includes a numerical bettor indicator adjacent to a symbol or video feed representing the respective participants in the group play and showing a total amount wagered on the respective participant by bettors.

13. The gaming system of claim 8, further comprising a portable device coupled to the wagering controller over the network and operable to present the competition wager interface to a respective bettor using the portable device.

14. The gaming system of claim 8, further comprising:

(a) an overhead display device residing at a position above two of more of the gaming machines; and (b) wherein the wagering controller selectively instructs the overhead display device to display real-time leader board information including displaying a leader board, the leader board including current relative positions of participants in the group play, the leader board further including an indication of how much bettor wagering is backing the respective participants in the group play.

15. The gaming system of claim 14, wherein the indication of how much bettor wagering is backing the respective participants in the group play includes a numerical bettor indicator adjacent to a symbol or video feed representing the respective participants in the group play and showing a total amount wagered on the respective participant by bettors.

16. The gaming system of claim 8, in which the wagering controller is connected to the Internet through a firewall and operable to allow the device to access the competition wager interface over the Internet.

17. The gaming system of claim 8, in which the wagering controller is further operable for presenting a player independent wager interface providing bettors the capability to wager on a competition outcome independently of which player wins the competition.

18. One or more tangible nontransitory computer readable media containing program code instructions executable by a wagering controller for:

(a) under control of the wagering controller operatively connected to a set of networked gaming machines, configuring at least some of the set of networked gaming machines to operate in a competition operating mode for group play;

(b) during the competition operating mode, providing a competition wager interface under control of the wagering controller, the competition wager interface including a first players remaining interface display area showing a group of currently remaining gaming machines in the competition and enabling selection of one or more of the currently remaining gaming machines to wager upon, and a second wagering interface display area controlled by the selection of the one or more currently remaining gaming machines and presenting a group of potential wagers to be made on an eventual outcome of the competition, at least one of the potential wagers presented with a target result and calculated wager odds of reaching the target result;

(c) enabling a device to access the competition wager interface and allow a first bettor to view, make selections, and activate wagers on the eventual outcome of the competition through the competition wager interface, the device comprising (i) a remote device which is remote to the gaming system with the wager competition interface displayed on an electronic display associated with the remote device or (ii) one of the gaming machines with the wager competition interface displayed on an electronic display of that gaming machine; and (d) awarding a prize to the first bettor based on winning an activated wager of the first bettor.

19. The one or more tangible nontransitory computer readable media containing program code of claim 18, wherein the second wagering interface display area includes a graphical meter presented indicating a current point score associated with the selection of the one or more currently remaining gaming machines.

20. The one or more tangible nontransitory computer readable media containing program code of claim 18, further comprising enabling at least one handheld device to access the competition wager interface and allowing second bettor on the handheld device to view, make selections, and activate wagers on the eventual outcome of the competition through the competition wager interface.

* * * * *